US006179406B1

(12) United States Patent
Ito et al.

(10) Patent No.: US 6,179,406 B1
(45) Date of Patent: Jan. 30, 2001

(54) INK-JET PRINTER WITH INK NOZZLE PURGING DEVICE

(75) Inventors: Takuro Ito; Yoshihide Akuzawa; Norio Kouzu, all of Shizuoka-ken; Yasuhiro Suzuki, Numazu; Hitoshi Ushiogi, Mishima, all of (JP)

(73) Assignee: Toshiba Tec Kabushiki Kaisha, Tokyo (JP)

( * ) Notice: Under 35 U.S.C. 154(b), the term of this patent shall be extended for 0 days.

(21) Appl. No.: 09/152,411

(22) Filed: Sep. 14, 1998

(30) Foreign Application Priority Data

| | | |
|---|---|---|
| Sep. 19, 1997 | (JP) | 9-255710 |
| Jan. 23, 1998 | (JP) | 10-010874 |
| Aug. 5, 1998 | (JP) | 10-221555 |

(51) Int. Cl.[7] ..... B41J 2/165
(52) U.S. Cl. ..... 347/35
(58) Field of Search ..... 347/84, 30, 20, 347/31, 32, 33, 34, 35, 36, 37, 85, 86, 87, 92; 346/140.1, 139; 417/322

(56) References Cited

U.S. PATENT DOCUMENTS

| | | | | |
|---|---|---|---|---|
| 4,399,446 | * | 8/1983 | Mc Cann et al. | 346/75 |
| 4,558,326 | | 12/1985 | Kimura et al. | 433/80 |
| 4,594,159 | | 6/1986 | Stalberg | 210/198 |
| 5,281,137 | | 1/1994 | Jousson | 347/30 |
| 5,906,481 | * | 5/1999 | Ogawa et al. | 417/322 |
| 5,988,802 | * | 12/1999 | Pawlowski et al. | 347/87 |
| 6,000,785 | * | 12/1999 | Sakai et al. | 347/20 |
| 6,007,184 | * | 12/1999 | Terasawa et al. | 347/37 |

FOREIGN PATENT DOCUMENTS

| | | |
|---|---|---|
| 28 48 737 U | 5/1980 | (DE) . |
| 0 714 775 A2 | 6/1996 | (EP) . |
| 2021734 | 12/1979 | (GB) . |
| 59-48838 | 3/1984 | (JP) . |
| 3-184872 | 8/1991 | (JP) . |
| 4-38434 | 3/1992 | (JP) . |
| WO 93/17867 | 9/1993 | (WO) . |

OTHER PUBLICATIONS

Patent Abstracts of Japan, JP 02–266182A (Tatsuo Okazaki), Oct. 30, 1990—Abstract.
Patent Abstracts of Japan, vol. 015, No. 021 (M–1070), Jan. 17, 1991 and JP 02–266182A (Tatsuo Okazaki), Oct. 30, 1990—Abstract.

* cited by examiner

*Primary Examiner*—N. Le
*Assistant Examiner*—K. Feggins
(74) *Attorney, Agent, or Firm*—Frishauf, Holtz, Goodman, Langer & Chick, P.C.

(57) ABSTRACT

An ink-jet printer with an ink nozzle purging device includes a valve equipped in a portion of an ink supply pipe extending from a pump to a printing head unit, and an ink urging unit which has a chamber equipped in a portion of the pipe between the valve and the pump, and further has an elastic member disposed in the chamber. The member accumulates an elastic force by a pressure of the ink entering into the chamber while the pump is operated with the valve being closed, and then urges the ink toward the printing head unit when the valve is opened to release the elastic force accumulated in the elastic member.

21 Claims, 3 Drawing Sheets

INK-JET PRINTER WITH INK NOZZLE PURGING DEVICE

BACKGROUND OF THE INVENTION

The present invention relates to an ink-jet printer, and more particularly, to an ink-jet printer with an ink nozzle purging device for purging an ink nozzle of a printing head of the ink-jet printer.

Well known is an ink-jet printer which controls ink ejection onto a recording medium such as a recording paper from a plurality of ink nozzles formed in a printing head in an orderly manner to record a desired image on the recording medium. The ink-jet printer has widely been used in recent years, since the ink-jet printer is more excellent in running cost and printing speed as compared to an ink ribbon printer which transfers a desired image from a thermal transfer ink ribbon with a thermal head on a recording medium so that the image is recorded on the recording medium.

In the ink-jet printer, however, printing is hindered by ink clogging in the ink nozzle and a bubble generated in an ink passage extending from an ink tank or an ink cartridge to the ink nozzle. Hence, it is important to prevent the ink clogging and bubble generation in the ink passage in order to obtain a good printing result every time when the ink-jet printer is used.

In recent years, more precision of an image to be recorded on a recording medium has been made demanded and a nozzle diameter has progressively been smaller in accordance with this trend. As the nozzle diameter has been made smaller, though, the problem of the ink clogging at an ink nozzle has become more serious.

Moreover, in recent years, a further improvement of a printing speed has strongly been desired. In order to meet this desire, the following technical progress has been achieved in a method for recording an image on a recording medium by using a printing head. That is, while a small printing head had conventionally been reciprocated along a direction crossing a feed direction of a recording medium, in recent years a reciprocation of a printing head in the crossing direction has been unnecessary by designing a length of the printing head along the crossing direction so as to be almost the same as a length of the recording medium along the crossing direction (or a width of the medium).

As the length of the printing head is larger, the number of ink nozzles formed in the printing head increases and a length of an ink passage increases as well. Consequently, a more effective preventing device against the ink clogging and bubble generation has been demanded.

Such preventing devices have been known publicly by the published Jpn. Pat. Appln. KOKAI Publication No. 3-184872 published on Aug. 12, 1991 and the published Jpn. UM Appln. KOKAI Publication No. 59-48838 published on Mar. 31, 1984.

In an ink-jet printer disclosed in the published Jpn. Pat. Appln. KOKAI Publication No. 3-184872, ink is fed to a printing head 2 having a plurality of ink nozzles 2*a* through an ink supply pipe 3 equipped with a plurality of opening/closing valves 4, 5 from an main ink tank 1, and an ink circulation pipe 6 extends from the printing head 2 to the ink supply pipe 3 through an electromagnetic valve 7, an auxiliary ink tank 9 and a circulating pump 10. In a case where an ordinary image recording is performed, the printing head 2 is operated while the opening/closing valves 4, 5 are both closed, the electromagnetic valve 7 is opened and the circulating pump 10 is operated. If an ink level in the auxiliary tank 9 is lowered beyond a predetermined level, the opening/closing valves 4, 5 are both opened, the electromagnetic valve 7 is opened and the circulating pump 10 is activated. As a result of the procedures, the ink is fed from the main tank 1 into the auxiliary pump 9. Before the ordinary image recording begins, the opening/closing valve 5 located in the main ink tank 1 side on the ink supply pipe 3 is closed, the opening/closing valve 4 located in the printing head 2 side on the ink supply pipe 3 is opened, the electromagnetic valve 7 is opened and the circulating pump 10 is activated, while all of the plurality of ink nozzles 2*a* are made open in the printing head 2. As a result of the procedures, the ink circulates through the ink supply pipe 3, the printing head 2, and the ink circulation pipe 6. If a bubble is included in the ink, the bubble is discharged to the outside through the ink nozzles 2*a*. And a small amount of ink is also ejected through the ink nozzles 2*a* to clear ink clogging in the nozzles.

In an ink-jet printer disclosed in the published Jpn. UM Appln. KOKAI Publication No. 59-48838, an ink filter 3, electromagnetic valves 12, 13 and an ink pressurizing means 5 are equipped in ink pipes 9, 10 extending from an ink cartridge 1 to a recording head 4. The ink pressurizing means 5 is driven by an electromagnetic coil 82 (in an embodiment of FIG. 1), a combination of a motor 20 and a cam 21 (in an embodiment of FIG. 2) or a combination of a motor 30 and gears 31, 32 (in an embodiment of FIG. 3). In the case of an ordinary recording, the electromagnetic valves 12, 13 are opened, an operation of the ink pressurizing means 5 is stopped, and the ink is supplied from the ink cartridge 1 to the recording head 4 through the ink pipes 9, 10. When an ink nozzle, not shown, of the recording head 4 is purged, a piston 7 of the ink pressurizing means 5 is pressed while the electromagnetic valve 12 located in the ink cartridge 1 side on the ink pipe 9 is closed, and a pressure of the ink in the recording head 4 and in the ink pipe 10 located in the recording head 4 side is increased. After the ink nozzle is purged, the piston 7 of the ink pressurizing means 5 is returned back while the electromagnetic valve 13 is closed, and the ink pressurizing means 5 is filled with the ink flown out from the ink cartridge 1 through the ink pipe 9 located in the ink cartridge 1 side.

A structure for ink nozzle purging in the ink jet printer disclosed in the published Jpn. Pat. Appln. KOKAI Publication No. 3-184872 has a disadvantage that a large quantity of the ink is leaked out from the plurality of nozzles 2*a* of the printing head 2 because the ink is pressurized only by an action of the circulating pump 10 when the plurality of ink nozzles 2*a* of the printing head 2 are to be purged. This disadvantage is caused by that a long time is required for pressurizing the ink by the circulating pump 10 to a desired value necessary for the ink nozzle purging and for reducing the pressure of the ink to a pressure lower than the desired value after the ink nozzle purging is finished. The disadvantage becomes greater as the number of the ink nozzles 2*a* is increased.

In a structure for ink nozzle purging in the ink jet printer disclosed in the published Jpn. UM Appln.

KOKAI Publication No. 59-48838, as the number of printing heads 4 which are used in the ink jet printer is increased, the number of necessary ink pressurizing means 5 is also increased. Since the ink pressurizing means 5 is driven by the electromagnetic coil 82 (in the embodiment of FIG. 1), the combination of the motor 20 and the cam 21 (in the embodiment of FIG. 2) or the combination of the motor 30 and the gears 31, 32 (in the embodiment of FIG. 3), the number of wirings required for the electromagnetic coil 82 or the motors 20, 30 are increased, so that the structure of the ink nozzle purging device becomes complex and expensive.

The present invention has been derived from under such circumstances and an object of the present invention is to provide an ink-jet printer with a low cost ink nozzle purging device in which even if the number of printing heads which are used in the ink-jet printer or a size of each of the printing heads is increased or the number of ink nozzles formed in each printing head is increased, not only the ink nozzles can be surely purged but also a bubble in each printing head or in an ink supply pipe between an ink tank or an ink cartridge and the printing heads can be surely removed, besides, an amount of a leakage of the ink necessary for ink nozzle purging and discharging the bubble can be limited as small as possible and furthermore, a structure of the ink nozzle purging device does not become complex.

BRIEF SUMMARY OF THE INVENTION

In order to achieve the object of the present invention, an ink-jet printer with an ink nozzle purging device according to the present invention comprises: an ink supply source; a printing head unit having an ink passage and at least one ink nozzle communicating with the ink passage; an ink supply pipe which is used to supply an ink to the ink passage of the printing head unit from the ink supply source; an ink pressurizing pump equipped in the ink supply pipe; an opening/closing valve equipped in a portion of the ink supply pipe extending from the ink pressurizing pump to the printing head unit or equipped in a portion of the ink passage of the printing head unit up to the ink nozzle; and an ink urging unit which has a chamber equipped in a portion of the ink supply pipe between the opening/closing valve and the ink pressurizing pump, and further has an elastic member disposed in the chamber, the elastic member accumulating an elastic force by a pressure of the ink entering into the chamber while the ink pressurizing pump is operated with the opening/closing valve being closed, and then the elastic member urging the ink in the chamber toward the printing head unit when the opening/closing valve is opened to release the elastic force accumulated in the elastic member.

In the ink-jet printer with the ink-nozzle purging device according to the present invention and characterized by being constructed as described above, the printer may further has an ink return pipe which is used to return the ink to the ink supply source from the ink passage of the printing head unit.

The ink return pipe causes the ink in the printer to circulate so that a possibility of the ink clogging in the ink nozzle can be reduced.

In the ink-jet printer with the ink-nozzle purging device according to the present invention and characterized by being constructed as described above, the printing head unit can include a plurality of printing head members which are connected with each other in series and each of which has an ink passage connected to the ink passages of the other printing head members in series and has at least one ink nozzle communicating with the ink passage.

The printing head unit including the plurality of printing head members can provide a printing head unit which is large as a whole by combining the plurality of printing head members each of which can be easily manufactured at a low cost.

In the above described case, a portion of the ink supply pipe between the printing head unit and the ink urging unit can be constructed with a plurality of branched pipes respectively communicating with the ink passages in the plurality of printing head members of the printing head unit.

The plurality of branched pipes efficiently supply the ink urged by the ink urging unit to the ink nozzles of the plurality of printing head members through the respective ink passages of the plurality of the printing head members, and the nozzles of the plurality of printing head members can efficiently be purged.

It is preferable that the opening/closing valve is located in a portion of the ink supply pipe extending from the ink urging unit to the printing head unit.

The opening/closing valve located in this way makes the structure of the printing head unit simple.

When the opening/closing valve is located as described above and the printing head unit includes a plurality of printing head members each of which has an ink passage connected with the ink passages of the other printing head members in series and at least one ink nozzle communicating with the ink passage, a portion of the ink supply pipe extending from the opening/closing valve to the printing head unit can be constructed with a plurality of branched pipes communicating with the respective ink passages in the plurality of printing head members of the printing head unit.

In the ink-jet printer with the ink-nozzle purging device according to the present invention and characterized by being constructed as described above, another or a second opening/closing valve can be equipped in a portion of the ink supply pipe between the ink pressurizing pump and the ink urging unit. The second opening/closing valve is opened when the first opening/closing valve located in the printing head unit side on the ink supply pipe is closed in order to supply the pressurized ink pressurized by the ink pressurizing pump into the chamber of the ink urging unit. Further, the second opening/closing valve is closed when the first opening/closing valve in the printing head unit side on the ink supply unit is opened in order to supply the pressurized ink from the chamber of the ink urging unit toward the printing head unit by the elastic force accumulated in the elastic member of the ink urging unit.

Such a second opening/closing valve as described above increases the ink nozzle purging force because the second opening/closing valve prevents the urging force applied to the ink by the ink urging unit, in other words a purging force for purging the ink nozzle by the urged ink, from returning to the ink pressurizing pump through the ink supply pipe.

The elastic member can have a piston which slides in the chamber by receiving a pressure from the ink pressurized by the ink pressurizing pump and again slides in the chamber by the elastic force accumulated in the elastic member after the pressure from the ink pressurizing pump is not present.

Such a piston as described above effectively transmits not only the pressure from the ink to the elastic member but also the elastic force accumulated in the elastic member to the ink in the chamber.

The elastic member preferably includes a diaphragm defining a wall remote from the ink supply pipe in the chamber.

The elastic member constructed with the diaphragm does not need the piston.

It is preferable that the diaphragm is constructed with a synthetic resin sheet having elasticity.

It is preferable that the diaphragm has a plurality of annular recesses or annular projections respectively having different diameters and being arranged concentrically with each other. Such a diaphragm as described above can accumulate a large elastic force and thereby a large urging force can be applied to the ink in the chamber.

The elastic member can include an elastic element which is interposed between the diaphragm and a stationary member of the ink jet printer, and accumulates an elastic force and releases the elastic force in cooperation with the diaphragm.

The elastic element increases the urging force applied to the ink by the elastic member of the ink urging unit, that is a force applied from the urged ink to the ink nozzle to purge the ink nozzle.

The chamber preferably has a shape in which a cross sectional area is increased with a position of a cross section of the chamber being far away from the ink supply pipe.

The chamber having such a shape as described above enables the diaphragm to accumulate a larger force from the pressurized ink entering into the chamber, and enables the diagram to apply a larger urging force to the ink in the chamber.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

The construction of the ink jet-printer with the ink nozzle purging device according to the present invention and mentioned above, will be made apparent from descriptions about an embodiment and various modifications thereof according to the present invention, with reference to the accompanying drawing showing the embodiment and the various modifications thereof, in which.

The embodiment and various modifications of the present invention will be described below in more detail with reference to the accompanying drawing.

DETAILED DESCRIPTION OF THE INVENTION

Figure 1:
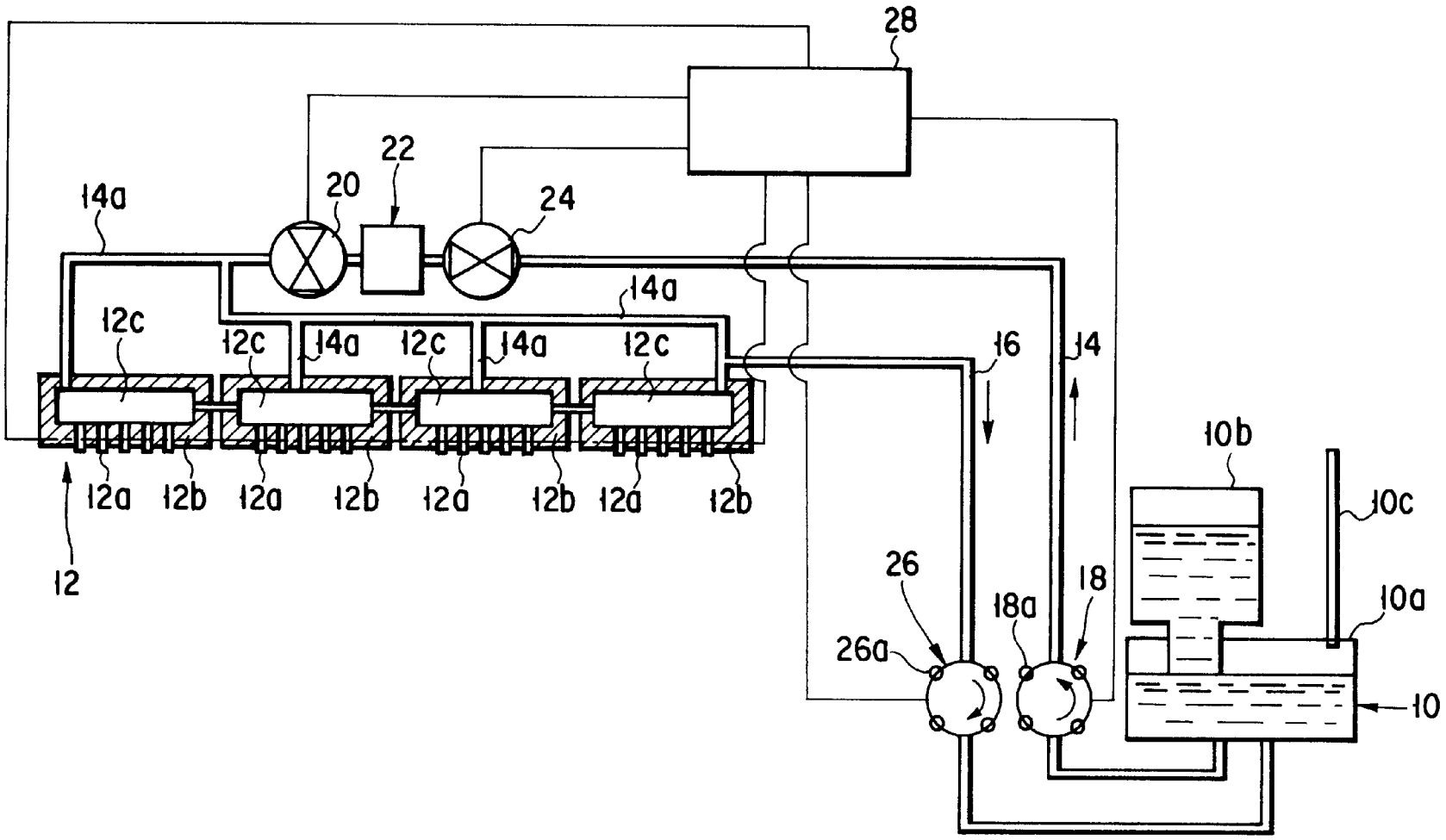
FIG. 1 is a schematic view showing a whole construction of an ink-jet printer with an ink nozzle purging device according to an embodiment of the present invention.

First of all, a whole construction of an ink-jet printer with an ink nozzle purging device according to an embodiment of the present invention will be schematically described with reference to FIG. 1.

The ink-jet printer comprises: an ink supply source 10; a printing head unit 12 having at least one ink nozzle 12*a*; an ink supply pipe 14 which is used to supply an ink to the printing head unit 12 from the ink supply source 10; an ink return pipe 16 which is used to return the ink to the ink supply source 10 from the printing head unit 12; an ink pressurizing pump 18 equipped in the ink supply pipe 14; an opening/closing valve 20 equipped in a portion of the ink supply pipe 14 extending from the ink pressurizing pump 18 to the printing head unit 12; and an ink urging unit 22 equipped in a portion of the ink supply pipe 14 between the opening/closing valve 20 and the ink pressurizing pump 18. The ink-jet printer of the embodiment further comprises: another or a second opening/closing valve 24 equipped in a portion of the ink supply pipe 14 extending from the ink pressurizing pump 18 to the ink urging unit 22; and an ink returning pump 26 equipped in a portion of the ink return pipe 16 extending between the printing head unit 12 and the ink supply source 10.

In the embodiment, the ink supply source 10 includes: an ink tank 10*a*; an ink bottle 10*b* detachably mounted to the ink tank 10*a*; and an air escape pipe 10*c* provided in the ink tank 10*a*. In the embodiment, each of the ink pressurizing pump 18 and the ink return pump 26 includes a plurality of press rollers 18*a* or 26*a* which are pressed and rolled on an elastic pipe equipped in the ink supply pipe 14 or in the ink return pipe 16.

Each of the first and second opening/closing valves 20, 24 is so constructed as to be remotely controllable, for example an electromagnetic valve.

The printing head unit 12 includes a plurality of ink head members 12*b* connected with each other in a series, each having an ink passage 12*c* communicating with the ink passages 12*c* of the other printing head members 12*b* in series and a plurality of ink nozzles 12*a* arranged at predetermined intervals and communicating with the ink passage 12*c*. The ink passages 12*c* of the plurality of printing head members 12*b* are communicated with the ink supply pipe 14 in series, and each of the ink passage 12*c* constitutes an ink reservoir. Each of the plurality of ink nozzles 12*a* is equipped with a publicly known ink ejecting mechanism not shown, which is used to eject the ink in a selective manner from the corresponding ink nozzle 12*a*.

In the ink supply pipe 14, a portion of the ink supply pipe 14 between the printing head unit 12 and the opening/closing valve 20 located in the printing head unit 12 side is constructed with a plurality of branched pipes 14*a* respectively connected with the plurality of ink passages 12*c* of the plurality of printing head members 12*b* of the printing head unit 12.

The printing head unit 12 of the embodiment extends along a surface of a recording medium (not shown) in a direction crossing a transport direction of the recording medium at about right angles. In this embodiment, the recording medium is for example a paper sheet, and is transported at a predetermined speed by a transporting unit (not shown) of the ink-jet printer. Further, a length of the printing head unit 12 in the crossing direction (that is, a total length of all of the plurality of printing head members 12*b* arranged in series) is almost the same as a length of the recording medium (not shown) in the crossing direction.

The plurality of ink nozzles 12*a* of the plurality of printing head members 12*b* are arranged in a straight line extending in the crossing direction.

In the print head unit 12, the plurality of ink nozzles 12*a* of the plurality of ink head members 12*b* are arranged on an imaginary line extending in the crossing direction at a predetermined position in the transport direction of the recording medium on the transporting unit, and the printing head unit 12 can reciprocate in a predetermined distance along the imaginary line (for example, a half of a pitch of the plurality of ink nozzles 12*a*). As a result of the reciprocating movement, the plurality of ink nozzles 12*a* can make ink dots along the imaginary line on the recording medium with the number (or a density) of the ink dots being twice as the number of the ink nozzles of the ink-jet unit 12, so that an image can be printed with a density (a degree of minuteness) twice as much as the number of the plurality of ink nozzles 12*a*.

The ink pressurizing pump 18, the ink return pump 26, the two opening/closing valves 20, 24 and the ink ejecting mechanisms (not shown) of the plurality of ink nozzles 12*a* of the plurality of printing head members 12*b* of the printing head unit 12 are electrically connected to a control unit 28 of the ink-jet printer, and the control unit 28 controls operations of the these pumps 18, 26, valves 20, 24 and ink ejecting mechanisms.

Figure 2:
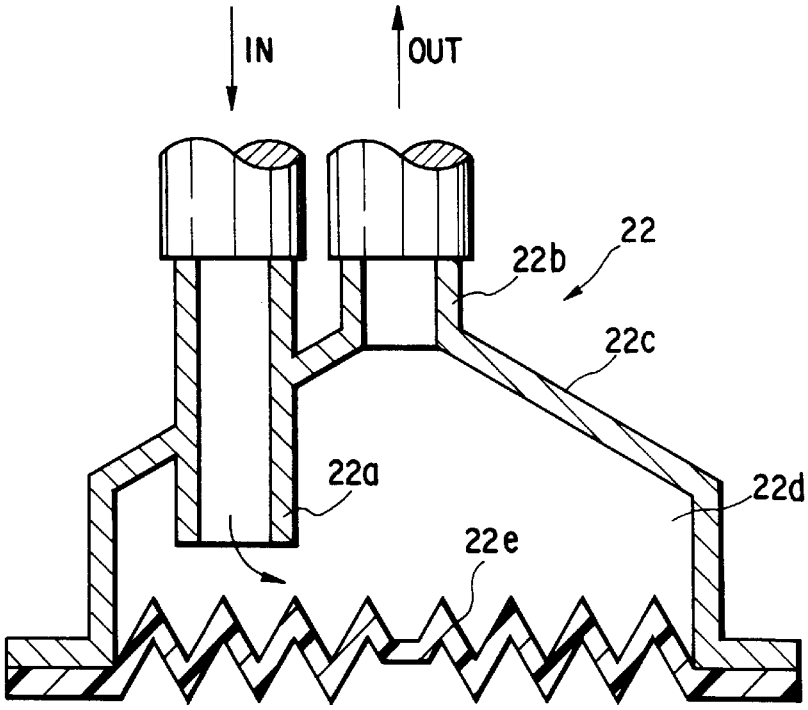
FIG. 2 is a longitudinal sectional view schematically showing a structure of an ink urging unit of the ink nozzle purging device according to the embodiment of the present invention.

Then, a structure of the ink urging unit 22 shown in FIG. 1 will be described in detail with reference to FIGS. 2 and 3, wherein FIG. 2 schematically shows an enlarged longitudinal section of the ink urging unit 22. As shown in FIG. 2, the ink urging unit 22 includes an ink introducing pipe 22*a* and an ink discharging pipe 22*b*. The introducing pipe 22*a* has an outer end communicating with a portion of the ink supply pipe 14 in the ink pressurizing pump 18 side, and the ink discharging pipe 22*b* has an outer end communicating with a portion of the ink supply pipe 14 in the printing head unit 12 side. Inner ends of the ink introducing pipe 22*a* and the ink discharging pipe 22*b* communicate with a chamber 22*d* of an ink urging vessel 22*c*, and the chamber 22*d* has a funnel shaped section. In more detail, the inner end of the ink introducing pipe 22*a* communicates with a portion of the funnel shaped chamber 22*d*, the portion being close to an outer end of the chamber 22*d* where a sectional area of the chamber 22*d* is large and being remote away from the ink supply pipe 14 of FIG. 1. The inner end of the ink discharging pipe 22*b* communicates with another portion of the funnel shaped chamber 22*d*, the portion being close to an inner end of the chamber 22*d* where the sectional area is smallest and being close to the ink supply pipe 14 of FIG. 1.

In the ink urging vessel 22*c*, a wall defining an outer end of the chamber 22*d* is constituted of a diaphragm 22*e*. The diaphragm 22*e* is made of an elastic sheet of a synthetic resin such as a polycarbonate. However, the diaphragm 22*e* can be made of a metal, a rubber and other synthetic resins as far as those do not deteriorate the quality of the ink in the chamber 22*d*.

Figure 3:
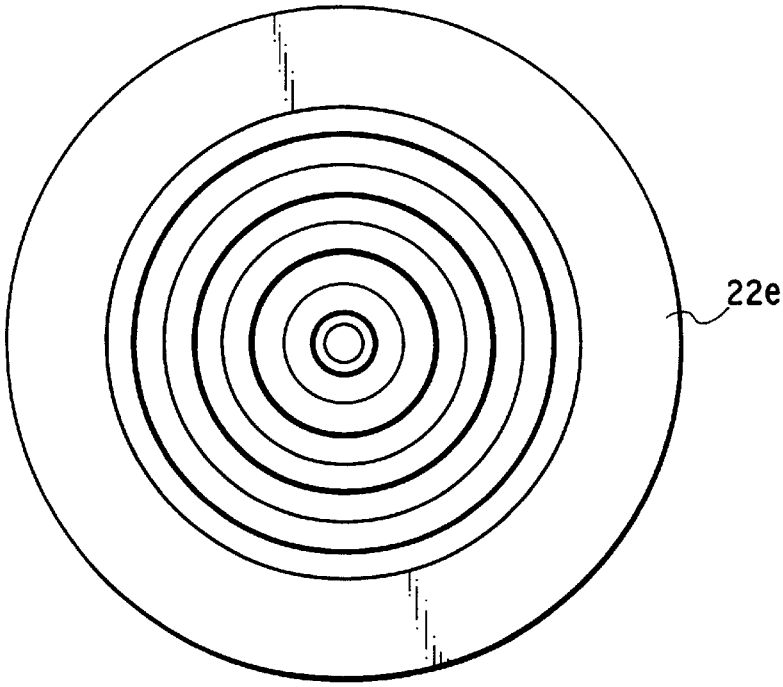
FIG. 3 is a schematic front view of a diaphragm used in the ink urging unit of FIG. 2.

As can be apparent from FIG. 2 showing a cross section of the diaphragm 22*e* and FIG. 3 showing a front view of the diaphragm 22*e*, the diaphragm 22*e* comprises a plurality of annular recesses or annular projections having different diameters and arranged concentrically.

Operations of the ink-jet printer with the ink nozzle purging device according to the embodiment characterized by being constructed as described above will be described below.

In a case where a recording of a desired image on the recording medium (not shown) by the ink-jet printer is started, it is firstly confirmed that the ink remains in the ink bottle 10*b*, then, a pair of the opening/closing valves 20, 24 are opened, the ink pressurizing pump 18 and the return pump 26 are operated for a predetermined time while the operations of the plurality of ink ejecting mechanisms (not shown) of the plurality of ink nozzles 12*a* of the plurality of printing head members 12*a* of the printing head unit 12 are stopped by the control unit 28.

Under this condition, the ink in the ink tank 10*a* is circulated through the ink supply pipe 14, the ink pressurizing pump 18, the opening/closing valve 24 in the ink pressurizing pump 18 side, the ink urging means 22, the opening/closing valve 20 in the printing head unit 12 side, the plurality of branched pipes 14*a* of the ink supply pipe 14, the plurality of ink passages 14*c* of the plurality of printing head members 12*b* of the printing head unit 12, the ink return pipe 16, the ink return pump 26, and the ink tank lOa. With this circulation, if an air bubble is included in the ink in any of the above described members, the bubble is collected in the ink tank 10*a* and then is discharged out to the outside of the ink tank 10*a* through the air escape pipe 10*c*.

Then, the recording medium (not shown) is transferred at a predetermined speed by the transport unit (not shown) as mentioned above while the printing head unit 12 is reciprocated in the predetermined distance in the crossing direction by the control unit 28 and at the same time the ink ejecting mechanisms (not shown) for the plurality of ink nozzles 12*a* of the plurality of printing head members 12*b* of the printing head unit 12 are selectively driven by the control 28, so that a desired ink image is printed on the recording medium.

In the case where the ink-jet printer has not been used for a long time and there is a possibility that ink is clogged at the plurality of ink nozzles 12*a* of the plurality of printing head members 12*a* of the printing head unit 12, an ink nozzle purging operation is performed by using the ink nozzle purging device including the two opening/closing valves 20, 24 and the ink urging unit 22 before a recording of a desired image on a recording medium (not shown) is started by the ink jet-printer.

The ink nozzle purging operation is started by closing the opening/closing valve 20 in the printing head unit 12 side, opening the opening/closing valve 24 in the ink pressurizing pump 18 side, stopping operation of the plurality of ink ejecting mechanisms (not shown) of the plurality of ink nozzles 12*a* of the plurality of printing head members 12*b* of the printing head unit 12, and making the operation of the ink return pump 26 being set in a stop condition, all of these procedures being performed by the control unit 28. Then, the control unit 28 makes the ink pressurizing pump 18 start its operation to send the ink from the ink tank 10*a* to the chamber 22*d* of the ink urging vessel 22*c* of the ink urging unit 22 through the ink introducing pipe 22*a*. Since the opening/closing valve 20 in the printing head unit 12 side is closed, the pressurized ink from the ink pressurizing pump 18 presses the diaphragm 22*e* in the chamber 22*d* to be expanded toward the outside, whereby an elastic force is accumulated in the diaphragm 22*e*.

The control unit 28 stops the operation of the ink pressurizing pump 18 after the pump 18 operates for a predetermined time, and makes the opening/closing valve 20 in the ink pressurizing pump 18 side close. Then, the control unit 28 makes the opening/closing valve 20 in the printing head unit 12 side open. As a result of this, the ink stored in the chamber 22*d* of the ink urging vessel 22*c* of the ink urging unit 22 is forcedly and rapidly flown into the plurality of ink passages 12*c* of the plurality of printing head members 12*b* of the printing head unit 12 through the plurality of the branched pipes 14*a* of the ink supply pipe 14 from the chamber 22*d* by the elastic force of the diaphragm 22*e*, and then the ink is powerfully ejected from the plurality of ink passages 12*c* to the outside through the plurality of ink nozzles 12*a*. These ink ejections are performed by the strong elastic force of the diaphragm 22*e* in a very short time in which the elastic force of the diaphragm 22*e* becomes weakened. Therefore, ink clogging occurring at the plurality of ink nozzles 12*a* is removed by a very small amount of the ink in a very short time.

At this time, since the ink discharge pipe 22*b* is connected to the narrowest inner end of the funnel shaped chamber 22*d* of the ink urging vessel 22*c*, the strong elastic force of the diaphragm 22*e* is more efficiently applied to the ink to be discharged from the ink discharge pipe 22*b*. This strengthens a purging action for the plurality of ink nozzles 12*a* by the ink urging unit 22.

In this embodiment, after a sufficient time needed for purging the plurality of ink nozzles 12*a*, the control unit 28 makes the pair of opening/closing valves 20, 24 open and makes the ink pressurizing pump 18 and the ink return pump 26 operate to automatically set a preparatory condition for ordinary printing, that is, recording operation.

In this embodiment, the portion of the ink supply pipe 14 between the opening/closing valve 20 in the printing head 12 side and the printing head unit 12 is constituted of the plurality of branched pipes 14*a*. But the portion can be constituted of one pipe to be connected only to the ink passage 12*c* of the printing head member 12*b* which is located farthest from the ink return pump 26, in other words located nearest to the opening/closing valve 20 in the printing head member 12 side, among the plurality of printing head members 12*b* disposed in series in the printing head unit 12, as far as ink clogging at the plurality of ink nozzles 12*a* of the plurality of ink passages 12*c* of the plurality of printing head members 12*b* of the printing head unit 12 can sufficiently be removed by the ink urged by the ink urging unit 22.

The maximal pressure of the ink which is discharged from the ink discharge pipe 22*b* of the ink urging unit 22 for purging the ink nozzles 12*a* can be freely changed by changing a time length elapsing from that the opening/closing valve 20 in the printing head unit 12 side is closed and the opening/closing valve 24 in the ink pressurizing pump 18 side is opened to that the ink pressurizing pump 18 is operated and then the opening/closing valve 24 in the ink pressurizing pump 18 side is closed and the opening/closing valve 20 in the printing head unit 12 side is opened, by changing an ink discharge quantity or an ink discharge pressure of the ink pressurizing pump 18, by changing a shape, sizes, or a sectional area of the chamber 22*d* of the ink urging unit 22, by changing an area, a sectional shape, a material and a thickness of the diaphragm 22*e*, etc.

In this embodiment, since the opening/closing valve 24 in the ink pressurizing pump 18 side, the ink return pipe 16 and the ink return pump 26 are not absolutely required, they can be removed from the printer. However, the opening/closing valve 24 effectively prevents the ink from returning from the ink urging unit 22 to the ink pressurizing pump 18 when the purging action is performed by the ink drive urging 22, so that the ink purging action can be prevented from being weakened. The ink return pipe 16 causes the ink in the printer to circulate so that a possibility of the ink clogging in the ink nozzles 12*a* can be reduced. The ink return pump 26 makes the ink circulation from the ink tank 10 to the ink tank 10 through the ink supply pipe 14, the ink urging unit 22, the pair of opening/closing valves 20, 24, the printing unit 12, and the ink return pipe 16 being more positively and securely.

Furthermore, the opening/closing valve 20 in the printing head unit 12 side can be replaced with the plurality of ink ejecting mechanisms (not shown) for the plurality of ink nozzles 12*a* if the plurality of ink ejecting mechanisms can stop a flow of the ink in the ink nozzles 12*a*, but if not, a plurality of opening/closing valve can be provided either at the plurality of ink nozzles 12*a* or in the ink passages 12*c*, respectively. Further, the opening/closing valve in the printing head unit 12 side can be provided in the ink passage 12*c* of the printing head member 12*b* located farthest from the ink return pump 26 among the plurality of ink head members 12*b* disposed in series of the printing head unit 12, when the portion of the ink supply pipe 14 between the plurality of printing head members 12*b* of the printing head unit 12 and the ink urging unit 22 is not constituted of the branched pipes 14*a* and, as mentioned above, the portion is constituted of one pipe connected only to the ink passage 12*c* of the printing head member 12*b* located farthest from the ink return pump 26.

Figure 4:
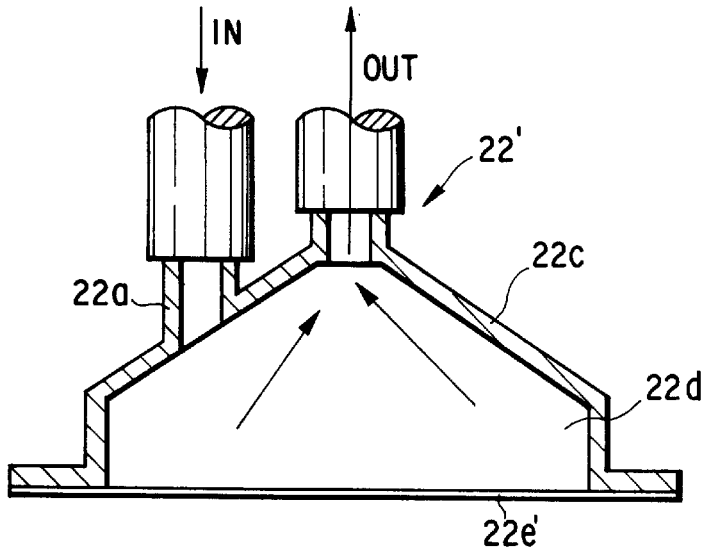
FIG. 4 is a longitudinal sectional view schematically showing a first modification of the ink urging unit of the ink nozzle purging device according to an embodiment of the present invention.

FIG. 4 schematically shows a longitudinal sectional view of a first modification of the ink urging unit 22 of the embodiment described above with reference to FIGS. 1 to 3. An ink urging unit 22' of the first modification is different from the ink urging unit 22 of the embodiment in a structure of the diaphragm thereof. More particularly, a diaphragm 22*e'* of the ink urging unit 22' of the first modification is formed of a material having elasticity such as rubber and being not provided with a plurality of annular recesses or projections disposed concentrically to each other.

The diaphragm 22*e'* of the ink urging unit 22' of the first modification is simpler in the structure as compared with the diaphragm 22*e* of the ink urging unit 22 of the embodiment. However, in order to apply the same urging force to the ink in the chamber 22*d*, the diaphragm 22*e'* of the ink urging unit 22' of the first modification requires a larger size and space for its action as compared with the diaphragm 22*e* of the ink urging unit 22 of the embodiment.

Figure 5:
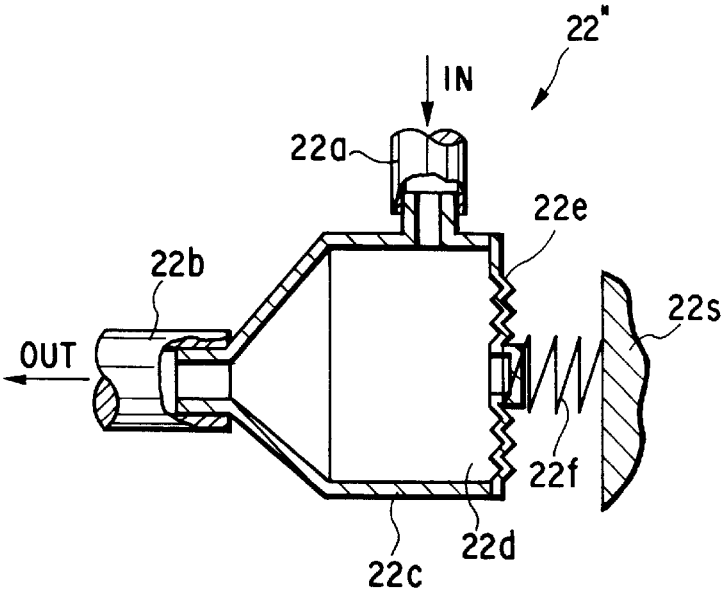
FIG. 5 is a longitudinal sectional view schematically showing a second modification of the ink urging unit of the ink nozzle purging device according to the embodiment of the present invention.

FIG. 5 shows a sectional view of a second modification of the ink urging unit 22 of the embodiment described above with reference to FIGS. 1 to 3. An ink urging unit 22' of the second modification is different from the ink urging unit 22 of the embodiment in its structure. More particularly, in the second modification, a second or another elastic member such as coil spring 22*f* is interposed between the central portion of the diaphragm 22*e* and a stationary member 22*s* which is another part of the ink jet printer. The second elastic member 22*f* accumulates an elastic force in cooperation with the diaphragm 22*e*, so that the ink urging unit 22' of the second modification can urge the ink for ink nozzle purging with a larger urging force than in the case of the ink urging unit 22 of the embodiment.

Figure 6:
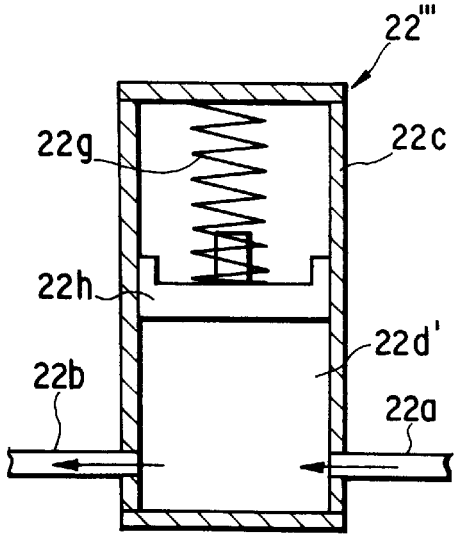
FIG. 6 is a longitudinal sectional view schematically showing a third modification of the ink urging unit of the ink nozzle purging device according to the embodiment of the present invention.

FIG. 6 schematically shows a longitudinal sectional view of a third modification of the ink urging unit 22 of the embodiment described above with reference to FIGS. 1 to 3. The ink urging unit 22''' of the third modification is different from the ink urging unit 22 of the embodiment in its structure. More particularly, in the third modification, each of an ink urging vessel 22*c'* and a chamber 22*d'* inside the vessel has a cylindrical shape, and an elastic member 22*g*, which is a compression coil spring in this modification, disposed farthest from the ink supply pipe 14, in other words farthest from the ink introducing pipe 22*a* and the ink discharging pipe 22*b*, in the chamber 22*d*' is provided with a piston 22*h* which slides in the chamber 22*d*' so that the piston 22*h* moves to or moves away from the ink supply pipe 14, that is the ink introducing pipe 22*a* and the ink discharging pipe 22*b*.

Such a piston 22*h* efficiently transmits a pressure 28 of the ink, fed into the chamber 22*d*' by the ink pressurizing pump 18 through the ink introducing pipe 22*a* while the opening/closing valve 20 in the printing head unit 12 side is closed and the opening/closing valve 24 in the ink pressurizing pump 18 side is opened, to the elastic member 22*g*, and efficiently transmit an elastic force accumulated in the elastic member 22*g* to the ink to be discharged from the chamber 22*d*' when the opening/closing valve 24 in the ink pressurizing pump 18 side is closed, the operation of the pump 18 stopped and the opening/closing valve 20 in the printing head unit 12 side is opened.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer with an ink nozzle purging device comprising:

an ink supply source;

a printing head unit having an ink passage and at least one ink nozzle communicating with the ink passage;

an ink supply pipe which is use to supply ink to the ink passage of the printing head unit from the ink supply source;

an ink pressurizing pump equipped in the ink supply pipe;

an opening/closing valve equipped in one of: (i) a portion of the ink supply pipe extending from the ink pressurizing pump to the printing head unit, and (ii) a portion of the ink passage of the printing head unit up to the ink nozzle; and an ink urging unit having (i) a chamber equipped in a portion of the ink supply pipe between the opening/closing valve and the ink pressurizing pump, and (ii) an elastic member disposed in the chamber, said elastic member accumulating an elastic force due to a pressure of ink entering into the chamber when the ink pressurizing pump is operated with the opening/closing valve closed, and said elastic member then urging ink in the chamber toward the printing head unit when the opening/closing valve is opened to release the elastic force accumulated in the elastic member.

2. An ink-jet printer with an ink nozzle purging device according to claim 1, wherein the printing head unit includes a plurality of printing head members which are connected with each other in series, and each of said printing head members has an ink passage connected to the ink passages of the other printing head members in series and at least one ink nozzle communicating with the ink passage thereof.

3. An ink-jet printer with an ink nozzle purging device according to claim 2, wherein a portion of the ink supply pipe between the printing head unit and the ink urging unit includes a plurality of branched pipes respectively communicating with the ink passages in the plurality of printing head members of the printing head unit.

4. An ink-jet printer with an ink nozzle purging device according to claim 1, wherein:

the opening/closing valve is located in a portion of the ink supply pipe extending from the ink urging unit to the printing head unit.

5. An ink-jet printer with an ink nozzle purging device according to claim 4, wherein the printing head unit includes a plurality of printing head members each of which has an ink passage connected with the ink passages of the other printing head members in series and at least one ink nozzle communicating with the ink passage thereof.

6. An ink-jet printer with an ink nozzle purging device according to claim 5, wherein a portion of the ink supply pipe between the printing head unit and the opening/closing valve includes a plurality of branched pipes respectively communicating with the ink passages of the plurality of printing head members of the printing head unit.

7. An ink-jet printer with an ink nozzle purging device according to claim 1, wherein the printer further comprises:

a second opening/closing valve equipped in a portion of the ink supply pipe between the ink pressurizing pump and the ink urging unit, and wherein the second opening/closing valve is opened when the first opening/closing valve is closed in order to supply ink pressurized by the ink pressurizing pump into the chamber of the ink urging unit, and wherein the second opening/closing valve is closed when the first opening/closing valve is opened in order to supply pressurized ink from the chamber of the ink urging unit toward the printing head unit due to the elastic force accumulated in the elastic member of the ink urging unit.

8. An ink-jet printer with an ink nozzle purging device according to claim 1, wherein:

the elastic member comprises a piston which slides in the chamber due to a pressure from ink pressurized by the ink pressurizing pumps and which again slides in the chamber due to the elastic force accumulated in the elastic member once pressure from the ink pressurizing pump is not present.

9. An ink-jet printer with an ink nozzle purging device according to claim 1, wherein:

the elastic member includes a diaphragm defining a wall remote from the ink supply pipe in the chamber.

10. An ink-jet printer with an ink nozzle purging device according to claim 9, wherein the diaphragm comprises a synthetic resin sheet having elasticity.

11. An ink-jet printer with an ink nozzle purging device according to claim 9, wherein the diaphragm has a plurality of annular recesses or annular projections which have which are arranged concentrically with each other.

12. An ink-jet printer with an ink nozzle purging device according to claim 9, wherein the printer further comprises a stationary member, and the elastic member includes an elastic element which is interposed between the diaphragm and the stationary member, and accumulates an elastic force and releases the elastic force in cooperation with the diaphragm.

13. An ink-jet printer with an ink nozzle purging device according to claim 1, wherein:

the chamber has a shape such that a cross sectional area thereof is increased at a cross-sectional position distant from the ink supply pipe.

14. An ink-jet printer with an ink nozzle purging device according to claim 1, wherein the printer further comprises:

an ink return pipe which is used to return ink to the ink supply source from the ink passage of the printing head unit.

15. An ink-jet printer with an ink nozzle purging device comprising:

an ink supply source;

a printing head unit having an ink passage and at least one ink nozzle communicating with the ink passage;

an ink supply pipe which is use to supply ink to the ink passage of the printing head unit from the ink supply source;

an ink pressurizing pump equipped in the ink supply pipe;

an opening/closing valve equipped in one of: (i) a portion of the ink supply pipe extending from the ink pressurizing pump to the printing head unit, and (ii) a portion of the ink passage of the printing head unit up to the ink nozzle; and an ink urging unit having (i) a chamber equipped in a portion of the ink supply pipe between the opening/closing valve and the ink pressurizing pump, and (ii) an elastic member disposed in the chamber, said elastic member accumulating an elastic force due to a pressure of ink entering into the chamber when the ink pressurizing pump is operated with the opening/closing valve closed, and said elastic member then urging ink in the chamber toward the printing head unit when the opening/closing valve is opened to release the elastic force accumulated in the elastic member;

wherein the elastic member includes a diaphragm defining a wall remote from the ink supply pipe in the chamber of the ink urging unit; and wherein an opening of a part of the ink supply pipe extending from the ink urging unit to the printing head unit or to the ink nozzle at the chamber of the ink urging unit is positioned to face the elastic member.

16. An ink-jet printer with an ink nozzle purging device according to claim 15, wherein the diaphragm has a plurality of annular recesses or annular projections which have respective different diameters and which are arranged concentrically with each other.

17. An ink-jet printer with an ink nozzle purging device according to claim 15, wherein the printer further comprises a stationary member, and the elastic member includes an elastic element which is interposed between the diaphragm and the stationary member, and accumulates an elastic force and releases the elastic force in cooperation with the diaphragm.

18. An ink-jet printer with an ink nozzle purging device according to claim 15, wherein:

the chamber has a shape such that a cross sectional area thereof is increased at a cross sectional position of the chamber distant from the ink supply pipe.

19. An ink-jet printer with an ink nozzle purging device according to claim 15, wherein the printing head unit includes a plurality of printing head members which are connected with each other in series, and each of said printing head members has an ink passage connected to the ink passages of the other printing head members in series and at least one ink nozzle communicating with the ink passage thereof.

20. An ink-jet printer with an ink nozzle purging device according to claim 15, wherein a portion of the ink supply pipe between the printing head unit and the ink urging unit includes a plurality of branched pipes respectively communicating with the ink passages in the plurality of printing head members of the printing head unit.

21. An ink-jet printer with an ink nozzle purging device according to claim 15, wherein the printer further comprises:

a second opening/closing valve equipped in a portion of the ink supply pipe between the ink pressurizing pump and the ink urging unit, and wherein the second opening/closing valve is opened when the first opening/closing valve is closed in order to supply ink pressurized by the ink pressurizing pump into the chamber of the ink urging unit, and wherein the second opening/closing valve is closed when the first opening/closing valve is opened in order to supply pressurized ink from the chamber of the ink urging unit toward the printing head unit due to the elastic force accumulated in the elastic member of the ink urging unit.

* * * * *